US011313644B1

(12) United States Patent
Kirk et al.

(10) Patent No.: US 11,313,644 B1
(45) Date of Patent: Apr. 26, 2022

(54) ADJUSTABLE APPARATUS HOLDER

(71) Applicant: U.S. Government as Represented by the Secretary of the Army, Natick, MA (US)

(72) Inventors: John Kirk, Ashland, MA (US); Matthew J Hurley, Framingham, MA (US); Rachel L Matusek, North Dartmouth, MA (US); Richard D Landry, Worcester, MA (US)

(73) Assignee: U.S. Government as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 16/903,547

(22) Filed: Jun. 17, 2020

Related U.S. Application Data

(63) Continuation of application No. 16/219,987, filed on Dec. 14, 2018, now abandoned.

(51) Int. Cl.

| | |
|---|---|
| ***F41C 33/04*** | (2006.01) |
| ***F41C 33/02*** | (2006.01) |
| ***A45F 5/02*** | (2006.01) |
| *A45F 5/00* | (2006.01) |

(52) U.S. Cl.
CPC ..... *F41C 33/0263* (2013.01); *A45F 5/021* (2013.01); *F41C 33/045* (2013.01); *A45F 2005/002* (2013.01); *A45F 2005/025* (2013.01)

(58) Field of Classification Search
CPC ..... F41C 33/045; F41C 33/0263; F41C 33/0227; F41C 33/041; F41C 33/0209; A45F 2200/0591; A45F 2005/025; A45F 2005/026; Y10T 403/60; Y10T 403/602; Y10T 403/608; F16M 3/02; F16M 13/022; G06F 1/187
USPC ..... 224/904, 930; 248/220.22, 220.21, 248/222.11, 221.12, 222.13, 222.5; 403/348; 52/434; 383/61.2, 63
See application file for complete search history.

(56) References Cited

U.S. PATENT DOCUMENTS

| | | | | | |
|---|---|---|---|---|---|
| 4,905,880 | A * | 3/1990 | Cupp | F41C 33/0227 | 224/192 |
| 5,018,654 | A * | 5/1991 | Rogers | F41C 33/0227 | 224/244 |
| 5,246,153 | A * | 9/1993 | Beletsky | A45F 3/14 | 224/192 |
| 5,282,559 | A * | 2/1994 | Wisser | F41C 33/0227 | 224/193 |

(Continued)

*Primary Examiner* — Adam J Waggenspack
(74) *Attorney, Agent, or Firm* — Roger C Phillips

(57) ABSTRACT

Embodiments described herein relate to apparatuses, systems and methods for adjustably holding a device. For example, in one embodiment, an apparatus is provided that includes a male interlocking ring. The male interlocking ring includes a plurality of male interlocking members. The apparatus also includes a unitarily formed female interlocking plate. The unitarily formed female interlocking plate includes portions adapted to receive each of the plurality of male interlocking members. The unitarily formed female interlocking plate also includes a flexible release lever. The flexible release lever partially extends laterally in one of the portions that are adapted to receive each of the plurality of male interlocking members. Other embodiments relate to an ambidextrous holster sleeve, a holster and holster sleeve.

6 Claims, 18 Drawing Sheets

(56) References Cited

U.S. PATENT DOCUMENTS

| | | | | | |
|---|---|---|---|---|---|
| 5,687,891 | A * | 11/1997 | Beletsky | F41C 33/0236 | 224/243 |
| 5,810,221 | A * | 9/1998 | Beletsky | F41C 33/0227 | 224/244 |
| 6,752,299 | B2 * | 6/2004 | Shetler | A45F 5/02 | 224/197 |
| 8,459,472 | B2 * | 6/2013 | Hofman | A47G 25/06 | 211/106.01 |
| 8,517,234 | B2 * | 8/2013 | Kincaid | F41C 33/045 | 224/198 |
| 8,631,981 | B2 * | 1/2014 | Zusman | F41C 33/0263 | 224/244 |
| 9,423,210 | B2 * | 8/2016 | Pellegrini | F41C 33/045 | |
| 9,777,986 | B1 * | 10/2017 | Lance | F41C 33/0254 | |
| 10,473,427 | B1 * | 11/2019 | Sereday | F41C 33/0254 | |
| 2006/0186152 | A1 * | 8/2006 | Williams | A45F 5/02 | 224/269 |
| 2007/0175935 | A1 * | 8/2007 | Clifton | F41A 17/00 | 224/243 |
| 2019/0077542 | A1 * | 3/2019 | Rizzuto | H04B 1/3888 | |

* cited by examiner

ADJUSTABLE APPARATUS HOLDER

CROSS-REFERENCE TO RELATED APPLICATIONS

This application claims benefit under 35 U.S.C. § 119(e) of U.S. Provisional Patent Application No. 62/599,966, filed on Dec. 18, 2017 and is incorporated herein by reference in its entirety.

STATEMENT OF GOVERNMENT INTEREST

The material described herein may be manufactured and used by or for the U.S. Government for governmental purposes without the payment of any royalties thereon or therefor.

FIELD OF THE DISCLOSURE

The present disclosure relates generally to apparatus, systems and methods for adjustably holding a device.

BACKGROUND

There are many apparatus holders on the market made of textiles, laminates, leather and plastics. In addition, some apparatus holders allow adjustable orientation with respect to a user. Although some of these apparatus holders are adjustable their design can often make these holders susceptible to environmental contaminates.

Some of the apparatus holders include a locking mechanism(s) to prevent unwanted extraction of the apparatus from the housing. However, these locking mechanisms are also susceptible to environmental contaminates. In addition, the apparatus holders and the ability to reorient them with respect to a user is non-ambidextrous.

BRIEF DESCRIPTION OF THE FIGURES

The accompanying figures, for which like reference numerals refer to identical or functionally similar elements throughout the separate views, together with the detailed description below, are incorporated in and form part of the specification. The figures serve to illustrate embodiments of concepts included in the claims and to show various features and advantages of those embodiments.

Figure 1A:
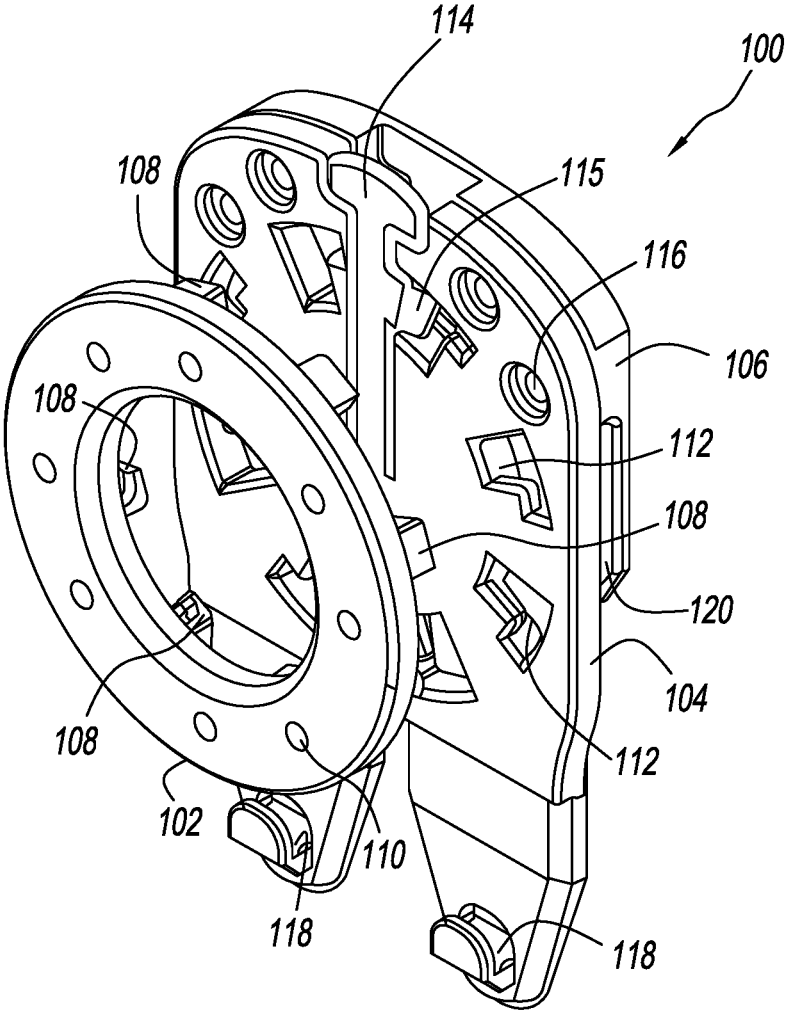
FIG. 1A shows a perspective view of an embodiment of a lock mount, in accordance with embodiments described herein.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

The system, apparatus and method components have been represented, where appropriate, by conventional symbols in the drawings, showing only those specific details that are pertinent to understanding the embodiments of the present teachings so as not to obscure the disclosure with details that will be readily apparent to those of ordinary skill in the art having the benefit of the description herein.

SUMMARY

Generally speaking, pursuant to various embodiments described herein, the present disclosure provides apparatuses, systems and methods for adjustably holding a device. For example, in one embodiment, an apparatus is provided that includes a male interlocking ring. The male interlocking ring includes a plurality of male interlocking members. The apparatus also includes a unitarily formed female interlocking plate. The unitarily formed female interlocking plate includes portions adapted to receive each of the plurality of male interlocking members. The unitarily formed female interlocking plate also includes a flexible release lever. The flexible release lever partially extends laterally in one of the portions that are adapted to receive each of the plurality of male interlocking members.

In another embodiment, an apparatus includes a left holster sleeve side that includes an outer surface and an inner surface having a first tongue slot. The apparatus also includes a right holster sleeve side secured to left holster sleeve side that includes an outer surface and an inner surface having a second tongue slot aligned with the first tongue slot. A flexible tongue coupled to the left holster sleeve side and the right holster sleeve side by insertion into the first tongue slot and the second tongue slot. The flexible tongue includes an inside surface and an outside surface.

In yet another embodiment, a unitary holster is provided. The unitary holster includes an additively manufactured left holster sleeve side that includes an outer surface, an inner surface and a first notch. The unitary holster also includes an additively manufactured right holster sleeve side coupled to the additively manufactured left holster sleeve side. The additively manufactured right holster sleeve includes an outer surface, an inner surface, and a second notch aligned with the first notch. An additively manufactured flexible tongue is coupled to the left holster sleeve side and the right holster sleeve side. The additively manufactured flexible tongue includes an inside surface and an outside surface. A slide catch that is adapted to be received by and aligned with the first notch and the second notch. The slide catch extends into a cavity formed by a combination of the additively manufactured left holster sleeve side, the additively manufactured right holster sleeve side and the additively manufactured flexible tongue.

DETAILED DESCRIPTION

The following detailed description references the accompanying figures in describing exemplary embodiments consistent with this disclosure. The example embodiments are provided for illustrative purposes and are not exhaustive. Additional embodiments not explicitly illustrated or described are possible. Further, modifications can be made to presented embodiments within the scope of the present teachings. The detailed description is not meant to limit this disclosure. Rather, the scope of the present disclosure is defined only in accordance with the presented claims and equivalents thereof.

Throughout this specification reference to "guns" is to include reference to other related products. Although a holster for guns is described, it will be realized that the material presented herein could be used in relation to many other products which are used in related fields such as, for example, holsters or containers for batons, hand cuffs, ammunition rounds, and the like.

This material described herein includes apparatuses that may be ambidextrous. Although not required the material described herein can be used with MOLLE webbing. This document incorporates by reference all of the material in U.S. Pat. No. 5,724,707 issued Mar. 10, 1998.

Figure 1B:
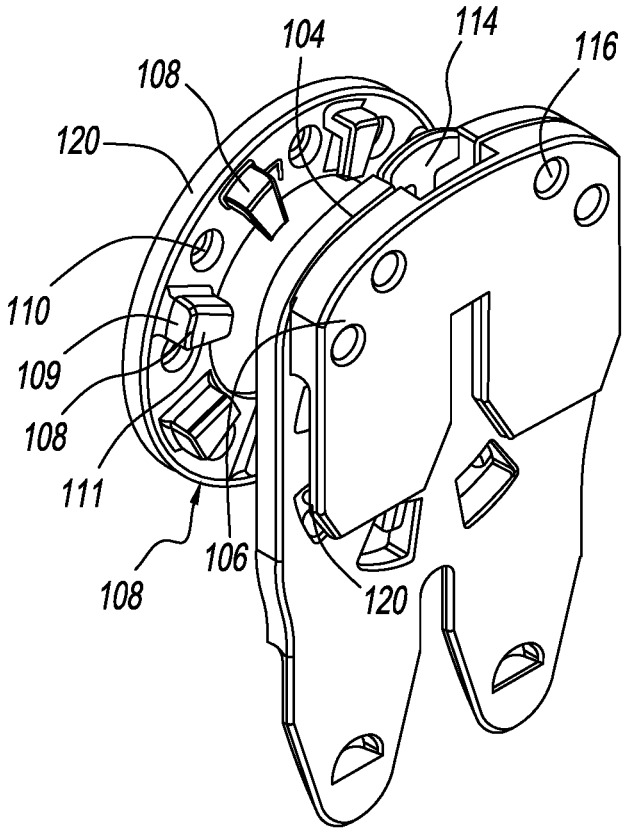
FIG. 1B is another perspective view of the lock mount depicted in FIG. 1A.

FIG. 1A shows a perspective view of an embodiment of an adjustable mount 100, in accordance with embodiments described herein. The adjustable mount 100 includes a male interlocking ring 102, a female interlocking plate 104 and a rear mounting plate 106. FIG. 1B is another perspective view of the adjustable mount depicted in FIG. 1A.

The male interlocking ring 102 includes a plurality of male interlock members 108. Each of the male interlock members 108 has a geometry that allows insertion into a female interlocking member 112. For example, each of the male interlock members 108 includes an extension 109 that has a proximal end connected to the male interlock ring 102. Extension 109 extends away from the male interlocking ring 102 to a distal end. Attached to the distal end of extension 109 is extension 111. Extension 111 extends laterally away from the distal end of extension 109. Extension 109 and extension 111 form an "L-shape."

For illustrative purposes only, the number of male interlock members 108 is depicted as eight. However, in other embodiments, the number of male interlock members 108 can be fewer than eight or greater than eight. The male interlocking ring 102 also includes a plurality of mounting holes 110.

The female interlocking plate 104 includes a plurality of female interlocking members 112, a release lever 114, a plurality of mounting holes 116, and at least one strap hook 118. For illustrative purposes only, the number of female interlock members 112 is depicted as eight. The female interlock members 112 have a shape that receives extension 109 and extension 111. The hole shape of each of the female interlock members 112 includes a first portion and a second portion where the first portion is larger than a second portion of the hole.

In various embodiments, the number of female interlock members 112 can be fewer than eight or greater than eight. In FIGS. 1A, 1B, 2, and 3 the number of female interlock member 112 correspond to the number of male interlock members 108. However, in various embodiments the number of female interlock members 112 is greater than the number of male interlock members 108.

The release lever 114 includes a lever stop 115. The lever-stop 115 extends laterally away from the release lever 114, towards and partially into the hole of one of the female interlock members 112.

The release lever 114 is a unitary part of the female interlocking plate 104. For example, when the female interlocking plate 104 is formed (e.g., via injection molding, stamped, additive manufactured (i.e., "3D printed"), or computer numerical control ("CNC")) the release lever 114 is also formed.

A user is able to position the device to a desired orientation by aligning the male interlock members 108 with the female interlock members 112. For example, when a holster is secured to the male interlocking ring 102, the holster may be oriented to a preferred drawing angle and aligned with female interlocking plate 104 via the male interlocking ring 102. In another example, the holster may be oriented for comfort when a user is in a seated position.

To secure the male interlocking ring 102 to the female interlocking plate 104, pressure is applied to the release lever 114. In one embodiment, a user deforms (i.e., bends) the release lever 114 by applying pressure causing the release lever 114 to move away from the male interlocking ring 102. The lever-stop 115 moves in unison with release lever 114. Pressing the release lever 114 moves the lever-stop 115 out of the way of a male interlock member 108. The male interlocking ring 102 is oriented appropriately and each male interlock member 108 is aligned with a female interlock member 112. The male interlock members 108 are inserted into the first portions of the female interlock members 104 and rotated (e.g., clockwise) towards the second portions in the female interlock members 104 that is smaller than the first portions.

After the male interlock members 108 are inserted into female interlock members 112, the user stops applying pressure to the release lever 114. When no pressure is applied to the release lever 114, a bias associated with the release lever 114 causes the release lever 114 to move back towards it's resting position (i.e., no force is applied to deform the release lever 114). When the release lever 114 and lever-stop 115 are in the resting position, the lever-stop obstructs one of the male interlock members 108 from being rotated and extracted from the corresponding female interlock member 112. Because the male interlock members 108 move in unison, impeding the movement of one of the male interlock members 108 also impedes movement of the other male interlock members 108.

The amount of pressure used to deform the release lever 114 is dependent upon multiple factors such, as for example, the material used to make the female interlocking plate 104 and release lever 114; and the geometry/dimensions of the release lever 114.

To disengage/separate the male interlocking ring 102 from the female interlocking plate 104, the user depresses the release lever 114. The male interlocking ring 102 is rotated in a direction opposite to the direction used to interlock the male interlocking ring 102 with the female interlocking plate 104. After rotation, the male interlocking ring 102 is separated from the female interlocking plate 104 and the release lever 114 is released.

In one embodiment the female interlocking plate 104 includes the mounting holes 116. Screws or bolts (not shown) can be used to secure the female interlocking plate 104 to the rear mounting plate 106. However, in various embodiments the female interlocking plate 104 does not include the mounting holes 116 and an adhesive is used to secure the female interlocking plate 104 to the rear mounting plate 106. In yet other embodiments, the female interlocking plate 104 and rear mounting plate 106 are constructed as one unitary piece. For example, the female interlocking plate 104 and rear mounting plate 106 are both formed together as one piece via injection molding, stamping, 3-D printing, or CNC.

The rear mounting plate 106 also includes hook portions 120 adapted to hook a strap (not shown). Hooking onto the strap supports components attached to the rear mounting plate 106. For example, when the rear mounting plate 106 is secured to a strap, the strap supports the rear mounting plate 106 and the female interlocking plate 104; the male interlocking ring 102; and an apparatus holder (e.g., any sleeve, holster, sheath, and/or apparatuses) attached to the male interlocking ring 102. The rear mounting plate 106 in conjunction with the strap hooks 118 secures the adjustable mount 100 in place.

For illustrative purposes only, the number of strap hooks 118 is depicted as two. However, various embodiments can include a different number of strap hooks 118. In various embodiments, the strap hooks 118 and rear mounting plate 106 are used to secure the adjustable mount 100 to a MOLLE system.

When formed as separate components, the male interlocking ring 102, the female interlocking plate 104 and rear mounting plate 106 can be made of separate materials and/or processes.

Figure 2:
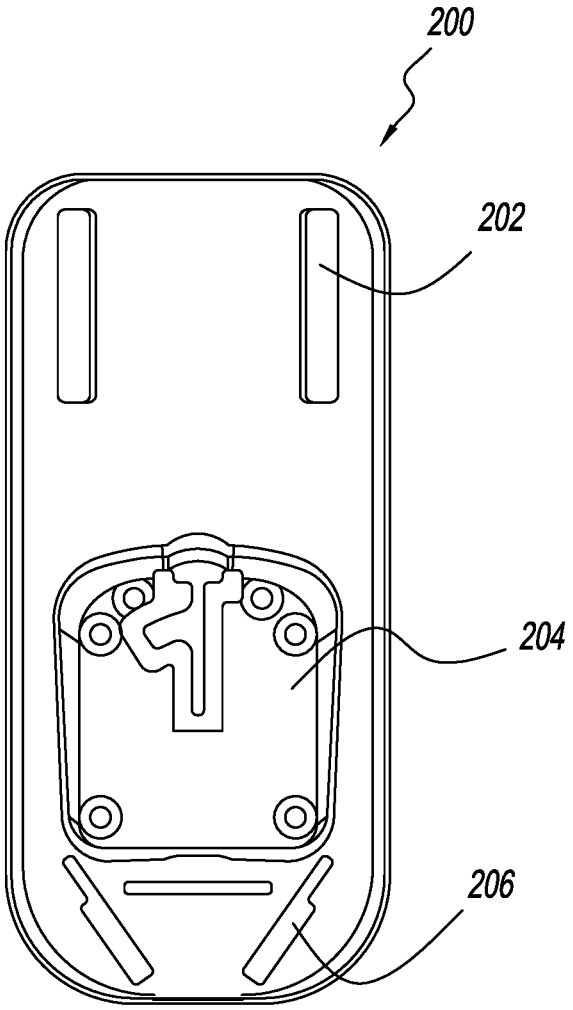
FIG. 2 is a perspective view of an embodiment of a lock mount, in accordance with embodiments described herein.

FIG. 2 is a perspective view of another embodiment of a lock mount 200, in accordance with embodiments described herein. The lock mount 200 is a belt mount. The lock mount 200 includes slots 202 and slots 206. The slots 202 and slots 206 are adapted to receive belts/straps (not shown) and secure the lock mount 200 to a user's waist.

The lock mount 200 includes female interlocking plate 204. The female interlocking plate 204 functions similarly to the female interlocking plate 104 described above. As such, the female interlocking plate 204 is not described in further detail. In various embodiments, the female interlocking plate 204 is formed as one unitary piece with the lock mount 200. In other embodiments, the female interlocking plate 204 and lock mount 200 are two separate pieces that are secured together (e.g., by screws or an adhesive).

Figure 3:
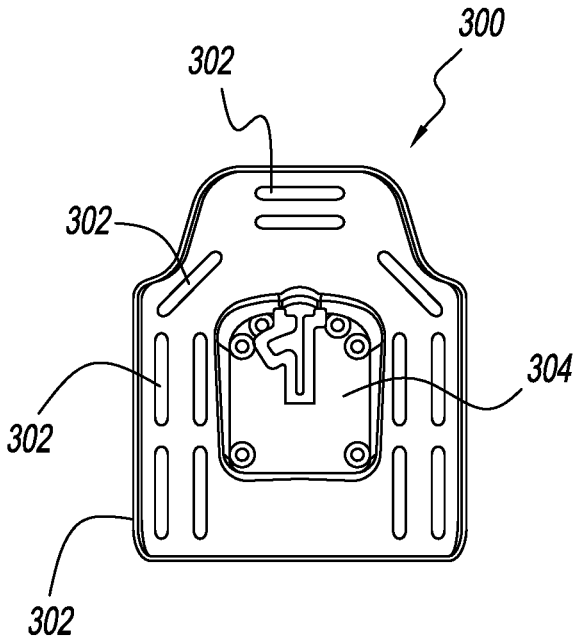
FIG. 3 is a perspective view of yet another embodiment of a lock mount, in accordance with embodiments described herein.

FIG. 3 is a perspective view of yet another embodiment of a lock mount 300, in accordance with embodiments described herein. The lock mount 300 is a leg mount. The lock mount 300 includes slots 302. The slots 302 are adapted to receive belts/straps (not shown) and secure the lock mount 300 to a user's leg. The lock mount 300 is worn lower on the user than the lock mount 200 secured to the waist.

The lock mount 300 includes female interlocking plate 304. The female interlocking plate 304 functions similarly to the female interlocking plate 104 described above. As such, the female interlocking plate 304 is not described in further detail. In various embodiments, the female interlocking plate 304 is formed as one unitary piece with the lock mount 300. In other embodiments, the female interlocking plate 304 and lock mount 300 are two separate pieces that are secured together (e.g., by screws or an adhesive).

In various embodiments, the male interlocking ring 102 is secured to the lock mount 100, 200, 300; and the female interlocking plate 104 is secured to a holster, sheath or sleeve. In various other embodiments, either the male interlocking ring 102 or the female interlocking plate 104 is secured to a vehicle, furniture, fixture, or building fixture.

Figure 4A:
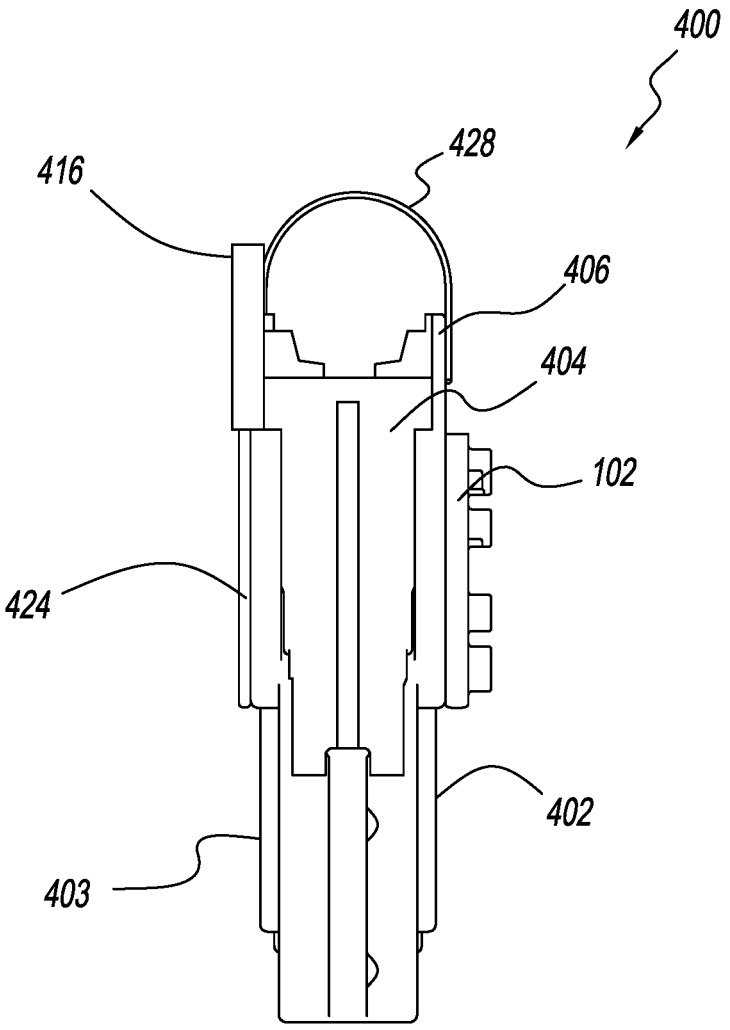
FIG. 4A depicts a top view of a holster sleeve with a top portion removed, in accordance with embodiments described herein

Various apparatus holders may be used with the lock mounts described herein. For example, FIG. 4A depicts a perspective view of a holster sleeve 400 with a portion removed so that a flexible tongue 404 is visible, in accordance with embodiments described herein. The holster sleeve 400 includes a left holster sleeve side 402 and a right holster sleeve side 403, the flexible tongue 404, a release 406 on one end of the flexible tongue 404, and a guard plate 424.

The left holster sleeve side 402 and right holster sleeve side 403 may be made simultaneously as one unitary piece (e.g., through injection molding) or made separately and subsequently secured together (e.g., via bonding, bolting or screwing these two components together).

Although not required, the release 406 is adapted to receive a thumb brake 416. To allow ambidextrous use of the release 406, the release 406 includes holes on both sides for receipt of screws (not shown) to secure the thumb brake 416 to the release 406.

In FIG. 4A, the thumb brake 416 is secured to the right side of the release 406 and flexible tongue 404; the guard plate 424 is secured to the right holster sleeve side 403; and the male interlocking ring 102 is secured to the left holder sleeve side 402. In this configuration, the holster sleeve 400 is worn on the right side of the user. However, by interchanging the guard plate 424 and the male interlocking ring 102; and moving the thumb brake 416 to the left side of the release 406 the holster sleeve 400 is configured to be worn on the left side of the user.

Although FIG. 4A depicts the holster sleeve 400 as including the male interlocking ring 102 other embodiments include the female interlocking plate 104 secured to the holster sleeve 400. Yet other embodiments include the holster sleeve 400 coupled in some manner to a user or object without either the male interlocking ring 102 or female interlocking plate 104.

FIG. 4A also depicts an optional elastomeric band 428. After insertion of the handgun into the holster sleeve 400, the elastomeric band 428 is stretched over the butt of the handgun (not shown). The elastomeric band 428 provides additional resistance from unwanted extraction of the handgun from the holster sleeve 400.

The left holster sleeve side 402 and the right holster sleeve side 403 each includes on their interior a tongue slot 436 that is adapted to receive the flexible tongue 404. When the left holster sleeve side 402, right holster sleeve side 403, flexible tongue 404 are together they form a cavity that is shaped to receive a handgun (not shown in the FIGs.). When the left holster sleeve side 402 and the right holster sleeve side 403 are together, the tongue slot 436 on each of them are aligned to hold a portion of the flexible tongue 404 in a fixed position with respect to the holster sleeve 400. Wedge 412 is one of multiple protrusions with successively smaller locating wedges which match cutouts in the flexible tongue 404. These wedges 412 locate the flexible tongue 404 in relation to the sleeve halves 402 and 403 and lock the flexible tongue 404 from being pulled out from the holster sleeve 400 once installed. This feature tapers down from a tapered portion 504 of the flexible tongue 404 in such a manner to eliminate stress concentrations at the point of flexure.

The left holster sleeve side 402 and right holster sleeve side 403 can be molded to accommodate any accessories mounted to the handgun. For example, the handgun may be either a XM-17 or XM-18 (both of which are registered trademarks of SIG SAUER, Inc. headquartered in Newington, N.H.).

Figure 4B:
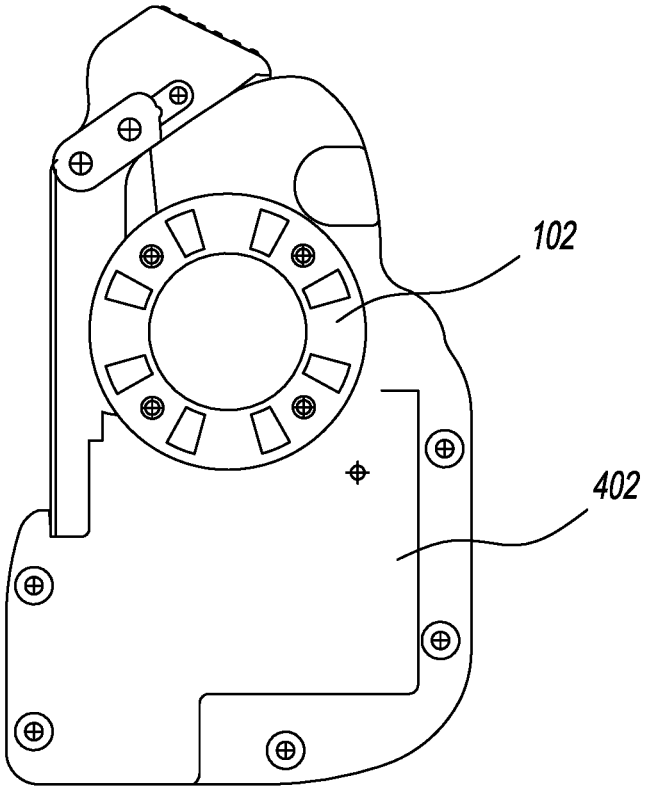
FIG. 4B depicts a side view of a portion of the holster sleeve depicted in FIG. 4A, in accordance with embodiments described herein.

FIG. 4B depicts a side view of the holster sleeve 400 depicted in FIG. 4A, in accordance with embodiments described herein.

Figure 4C:
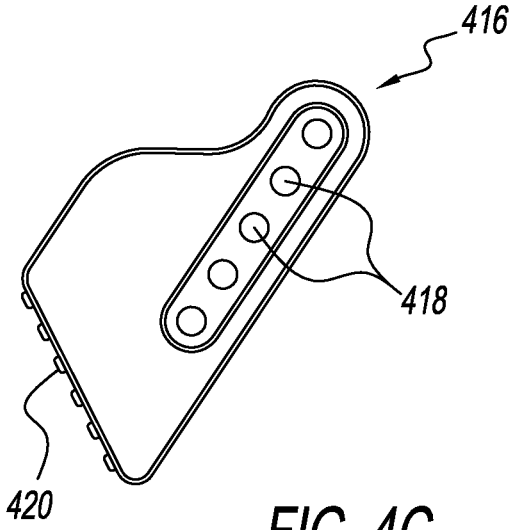
FIG. 4C depicts a perspective view of a thumb brake, in accordance with embodiments described herein.

FIG. 4C depicts a perspective view of a thumb brake 416, in accordance with embodiments described herein. The thumb brake 416 includes a plurality of threaded through-holes 418 that are used to receive screws for attachment of the thumb brake 416 to the release 406.

To allow a user ambidextrous use of the flexible tongue 404, the thumb brake 416 may be flipped over for mounting to either side of the release 406 and height adjustment for a user's thumb. In various embodiments, thumb brake 416 includes some type of texturing 420 that is an uneven surface to reduce the likelihood of a user's thumb slipping off the thumb brake 416.

Figure 4D:
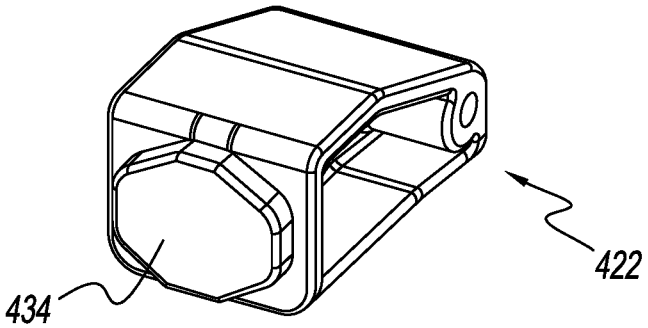
FIG. 4D depicts a perspective view of a spacer, in accordance with embodiments described herein.

FIG. 4D depicts a perspective view of an embodiment of a spacer 422, in accordance with embodiments described herein. When the holster sleeve 400 has been molded to accommodate the handgun that molding can also allow for accessories (not shown) mounted to the handgun. Examples of accessories that can be mounted to the handgun include but are not limited to a weapon light and/or handgun laser. When handgun is inserted in the holster sleeve 400, the handgun should fit into the holster sleeve 400 so that a portion of the flexible tongue 404 prevents extraction of the handgun.

When the interior of the holster sleeve 400 includes space for an accessory and the handgun does not include the accessory, the spacer 422 is placed inside the holster sleeve 400. The spacer 422 fills a void that would otherwise be occupied by the accessory installed on the handgun. The spacer 422 also includes a nib 426 which is a protrusion that allows a user to hold onto and extract the spacer 426 from the holster sleeve 400.

Figure 4E:
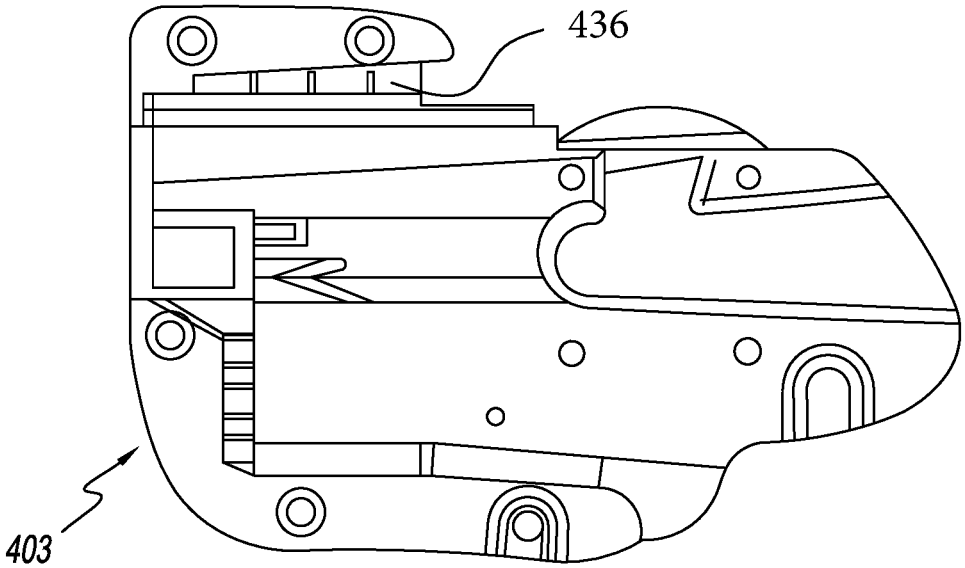
FIG. 4E depicts a cross-sectional view of the holster sleeve shown in FIG. 4A, in accordance with embodiments described herein.

FIG. 4E depicts a cross-sectional view of the holster sleeve shown in FIG. 4A, in accordance with embodiments described herein. In FIG. 4A, an interior of the right holster sleeve side 403 is shown so that the tongue slot 436 is visible.

Figure 5A:
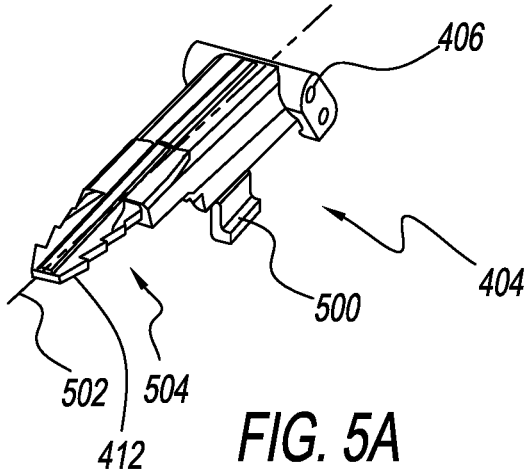
FIG. 5A depicts a perspective view of a flexible tongue, in accordance with embodiments described herein.

FIG. 5A depicts a perspective view of the flexible tongue 404, in accordance with embodiments described herein. The flexible tongue 404 includes a proximal end and a distal end. The release 406 is located on the proximal end of the flexible tongue 404. The flexible tongue 404 includes a longitudinal axis 502.

Also, on opposing peripheral edges of the flexible tongue 404 are slide catches 500. The slide catches 500 extend downward (i.e., away from the flexible tongue 404). The slide catches 500 align with an edge of a gun slide and ejection port of a handgun. The slide catches 500 prevent movement of the gun slide out of the holster sleeve 400. As a result, the slide catches 500 also prevent the handgun from being extracted out of the holster sleeve 400.

Moving away from the release 406 and after the slide catches 500 is a tapered portion 504. The tapered portion 504 has smaller dimensions than the proximal end of the flexible tongue 404. Because the tapered portion 504 has smaller dimensions, the tapered portion 504 has more flexibility than the proximal end. The tapered portion 504 also resides in the tongue slot 436.

Figure 5B:
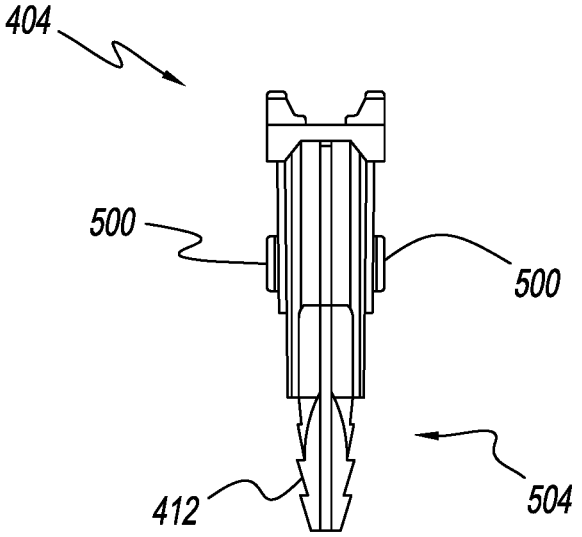
FIG. 5B depicts a top view of the flexible tongue depicted in FIG. 5A, in accordance with embodiments described herein.
Figure 5C:
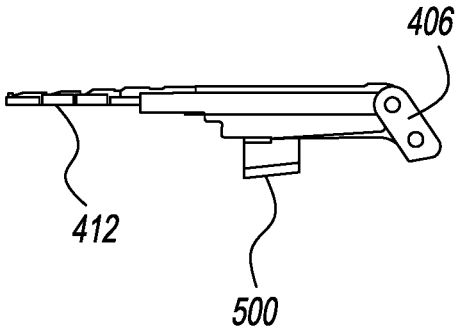
FIG. 5C depicts a rear view of the flexible tongue depicted in FIGS. 5A and 5B, in accordance with embodiments described herein.
Figure 5D:
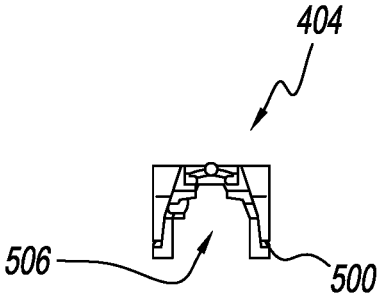
FIG. 5D depicts a side view of the flexible tongue in FIGS. 5A, 5B and 5C, in accordance with embodiments described herein.

The flexibility of the flexible tongue 404 is dependent upon multiple factors that include but are not limited to the material composition of the flexible tongue 404, the width of the flexible tongue and/or thickness of the flexible tongue 404. In addition, the flexible tongue 404 does not have to be made of the same material as the FIG. 5B depicts a top view of the flexible tongue depicted in FIG. 5A, in accordance with embodiments described herein. FIG. 5C depicts a side view of the flexible tongue in FIG. 5A, in accordance with embodiments described herein. FIG. 5D depicts a rear view of the flexible tongue depicted in FIGS. 5A and 5B, in accordance with embodiments described herein. FIG. 5D also shows a cavity 506 formed by the underside of the flexible tongue 404. A top portion of a handgun is in contact with the underside of the flexible tongue 404.

After a handgun is inserted into the holster sleeve 400, a user may further secure the handgun into the holster sleeve 400 by utilizing the optional elastomeric strap 428. To extract the handgun, a user places a thumb onto the thumb break 416 (or alternatively the release 406) and applies pressure to move the thumb break 416 away from the holster sleeve 400. The flexible tongue 404 flexes where there is no tongue slot 436 to hold the flexible tongue 404 in place. As the flexible tongue 404 rotates away from the holster sleeve 400, the slide catches 500 move away from the handgun slide. When the slide catches 500 are away from the handgun slide the handgun may be extracted from the holster sleeve 400.

The flexible tongue 404 does not have to made of the same material as the left holster sleeve side 402 or the right holster sleeve side 403. In addition, the left holster sleeve side 402 does not have to made of the same material as the right holster sleeve side 403.

Figure 6A:
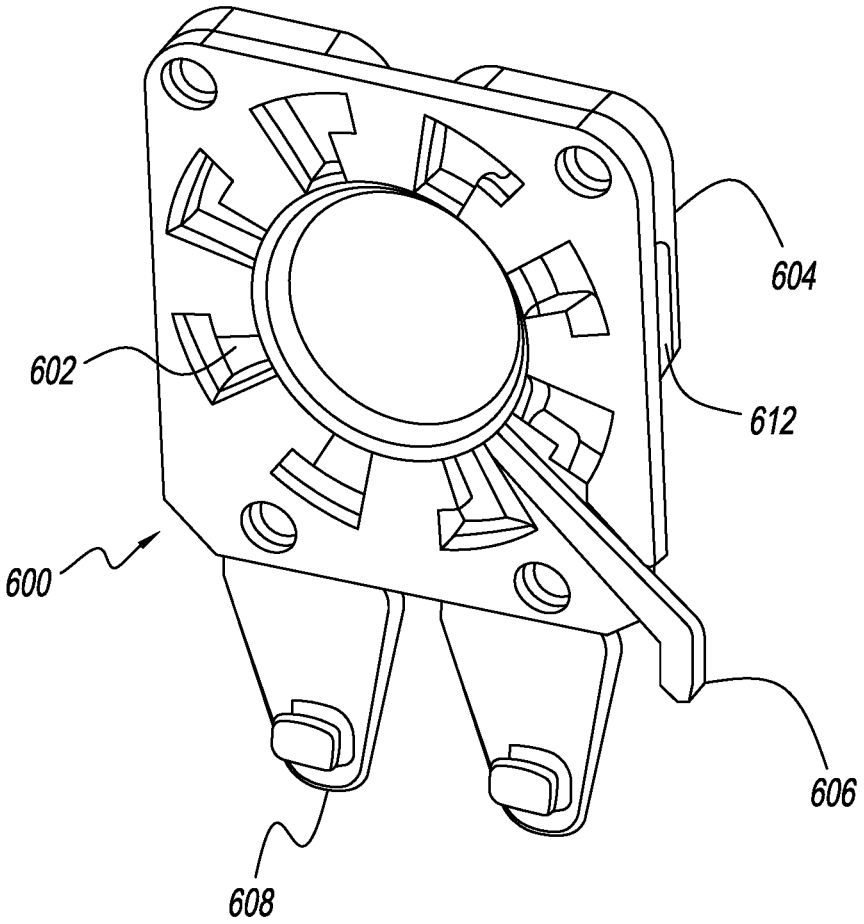
FIG. 6A depicts perspective view of another lock mount, in accordance with embodiments described herein.
Figure 6B:
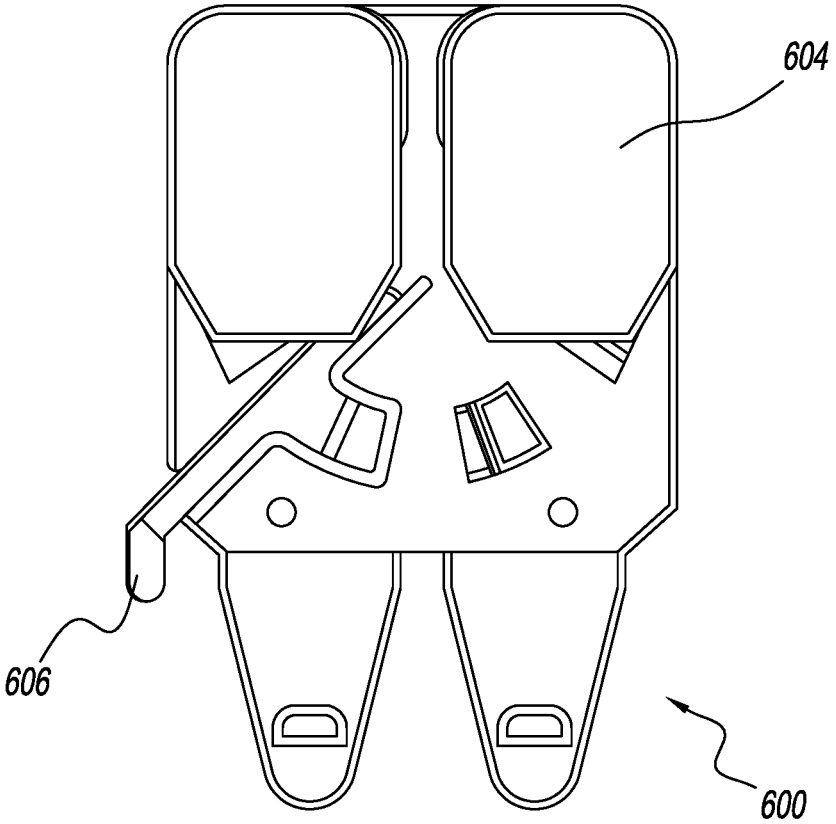
FIG. 6B depicts another perspective view of the lock mount depicted in FIG. 6A, in accordance with embodiments described herein.
Figure 6C:
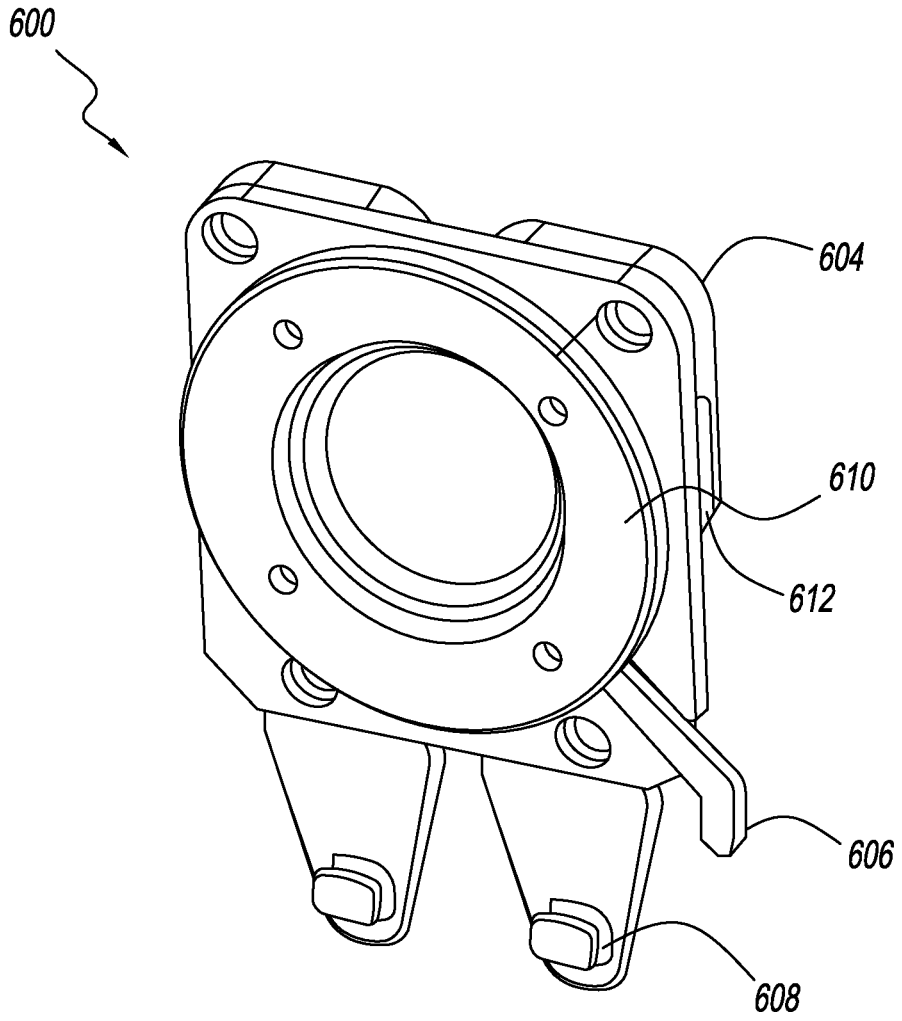
FIG. 6C depicts yet another perspective view of the lock mount depicted in FIGS. 6A and 6B, in accordance with embodiments described herein.

FIGS. 6A, 6B and 6C depict perspective views of another lock mount 600, in accordance with embodiments described herein. The lock mount 600 includes a male interlocking ring 610, female interlocking plate 602, and a rear mounting plate 604. Various components such as the male interlocking ring 610, the rear mounting plate 604, strap hooks 608, and strap hooks 612 operate the same as similarly named components described above and depicted in FIGS. 1A and 1B. For brevity, those components are not described again. However, female interlocking plate 602 includes a release lever 606 that is in the shape like that of a hockey stick and is actuated using a motion similar to that described with respect to the release lever 114 that is depicted in FIGS. 1A and 1B.

Figure 7A:
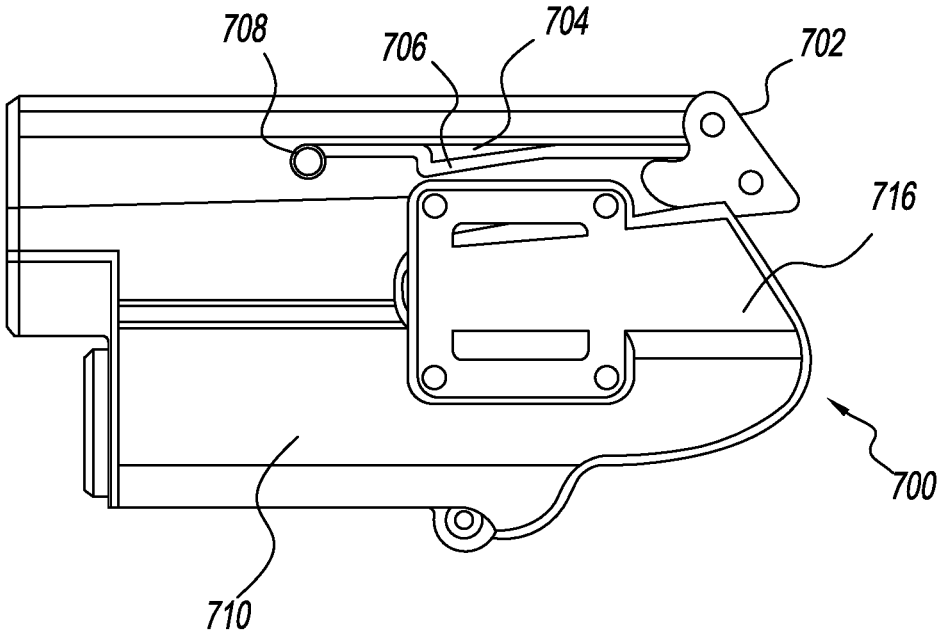
FIG. 7A depicts a perspective view of a unitary holster sleeve, in accordance with embodiments described herein.
Figure 7B:
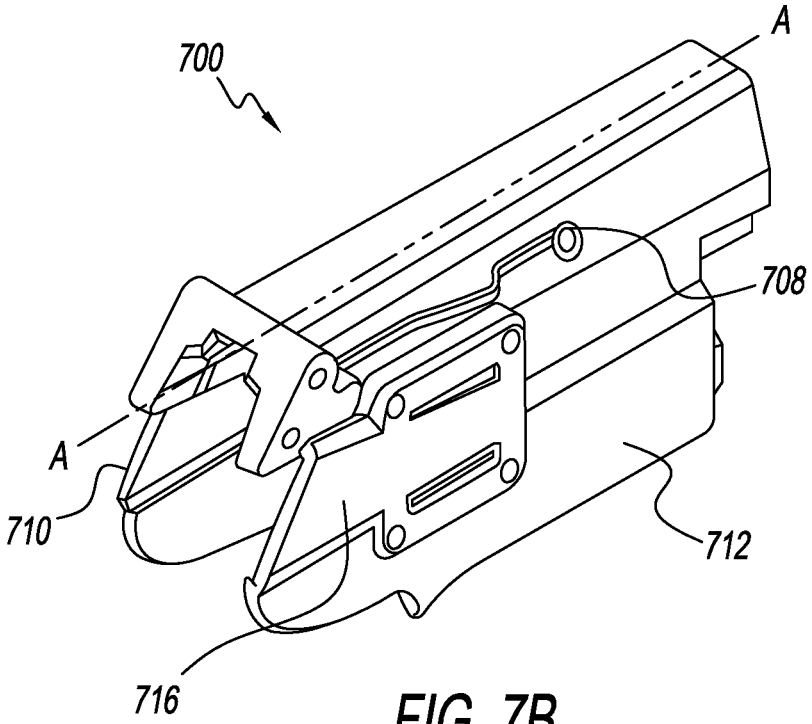
FIG. 7B depicts another perspective view of the unitary holster sleeve depicted in FIG. 7A, in accordance with embodiments described herein.

FIG. 7A depicts a perspective view of a unitary holster 700, in accordance with embodiments described herein. FIG. 7B depicts another perspective view of the unitary holster 700 depicted in FIG. 7A, in accordance with embodiments described herein. The unitary holster 700 includes a left holster sleeve side 710, flexible tongue 702 and right holster sleeve side 712 that are formed together. For example, the left holster sleeve side 710; right holster sleeve side 712; and flexible tongue 702 can be formed together via 3D Printing as a unified body. The flexible tongue 702 includes a slide catch 704 on each side of the flexible tongue 702 that extends partially into an area occupied by a handgun slide (not shown). The right holster sleeve side 712 and the left holster sleeve side 710 each include a notch 704. Also located on the right holster sleeve side 712 and the left holster sleeve side 710 is a rotation bore 708.

Because there is no notch 706 after the rotation bore 708, the flexible tongue 702 acts as a cantilever. The rotation bore 708 acts as a point of rotation for the flexible tongue 702 when a user applies force to the flexible tongue 702 as described above with respect to the movement of the flexible tongue 404. In various embodiments, the unitary holster 700 is ambidextrous similarly to the holster sleeve 400 described above.

Figure 7C:
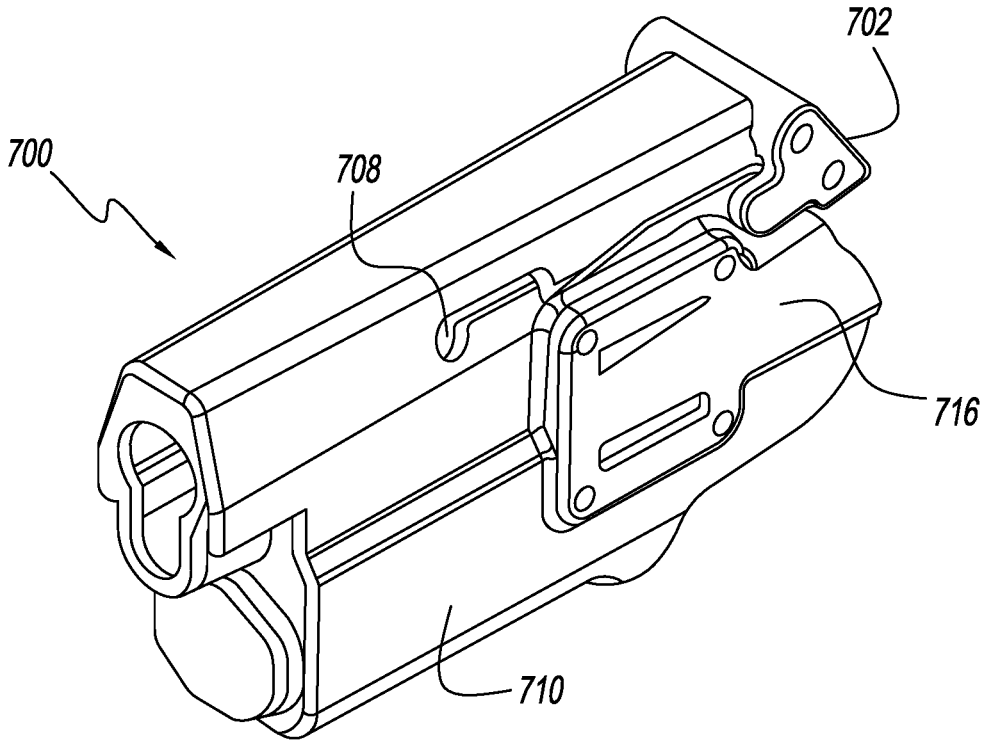
FIG. 7C depicts another perspective view of the unitary holster sleeve depicted in FIG. 7A, in accordance with embodiments described herein.

FIG. 7C depicts another perspective view of the unitary holster 700 depicted in FIG. 7A, in accordance with embodiments described herein. In FIG. 7C, the holster sleeve side 712 is visible. In addition, another mounting plate 716 is also present on the left holster sleeve side 712.

Figure 7D:
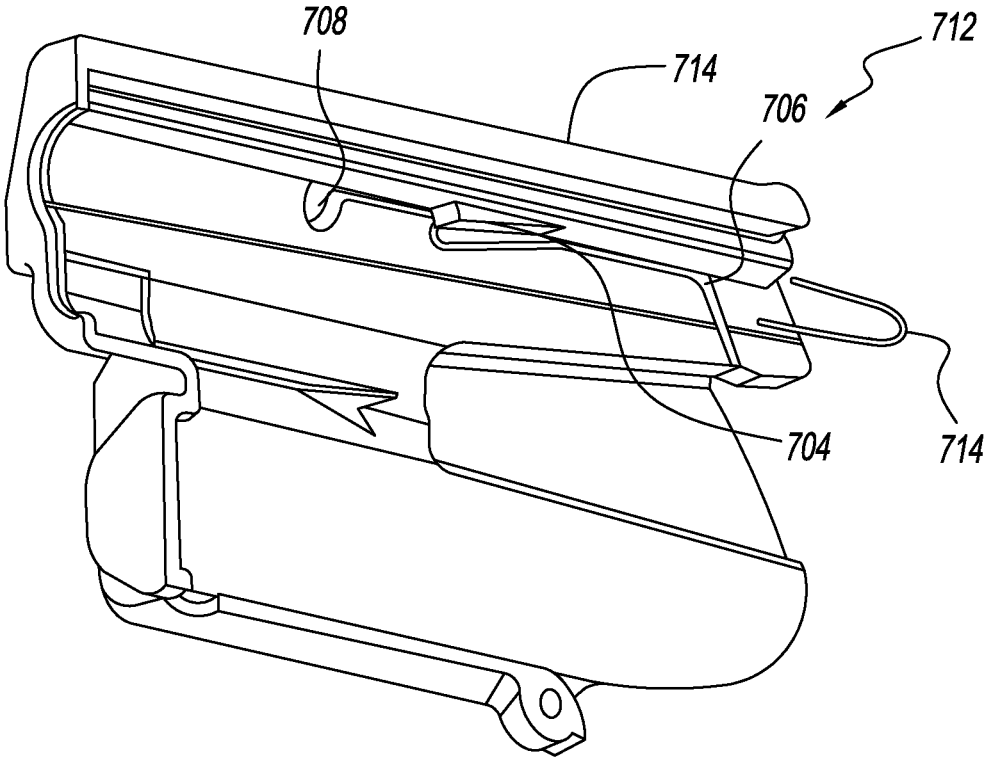
FIG. 7D depicts a cross-sectional view of the unitary holster sleeve along the A-A line depicted in FIG. 7B.

FIG. 7D depicts a cross-sectional view of the unitary holster sleeve 700 along the A-A line depicted in FIG. 7B. In this cross-sectional view, an elastomeric strap 714 is present. The elastomeric strap 714 is used to further secure a handgun within the holster sleeve 700. The elastomeric strap 714 operates similarly to the elastomeric band 428 described above.

Figure 8:
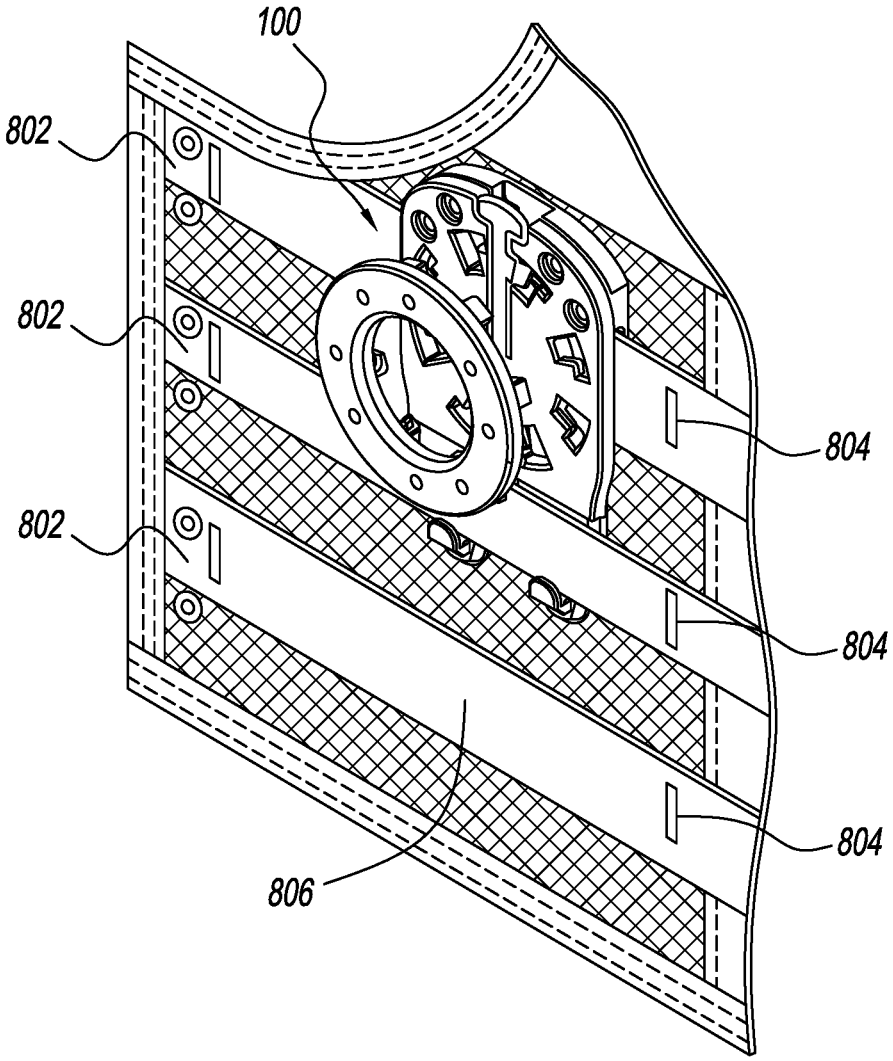
FIG. 8 depicts a lock mount secured to a vest, in accordance with embodiments described herein.

FIG. 8 depicts a lock mount secured to a vest 800, in accordance with embodiments described herein. The vest 800 includes what is also referred to herein as "MOLLE" webbing. MOLLE webbing includes a plurality of substantially horizontal webbing strips 802. The webbing strips 802 are spaced apart from one another. The webbing strips 802 are secured to the vest 800 by substantially vertical stitching 804 relative to the horizontal orientation of the webbing strips 802. Each webbing strip 802 includes multiple sets of stitching 804. Spacing between the webbing strips 802 and the vest 800 that is bounded by the stitching 804 form channels 806. These channels 806 allow items to be secured thereto. One type of item that may be secured to the channels 806 is the adjustable mount 100. The rear mounting plate 106, female interlocking plate 104 and space therebetween form strap hooks 120. A channel 806 is inserted into the strap hooks 120. The at least one strap hooks 118 are placed behind a webbing strip 802 below the webbing strip 802 having strap hooks 120 secured thereto. The at least one strap hook 118 is secured to the lower webbing strip 802.

Figure 9:
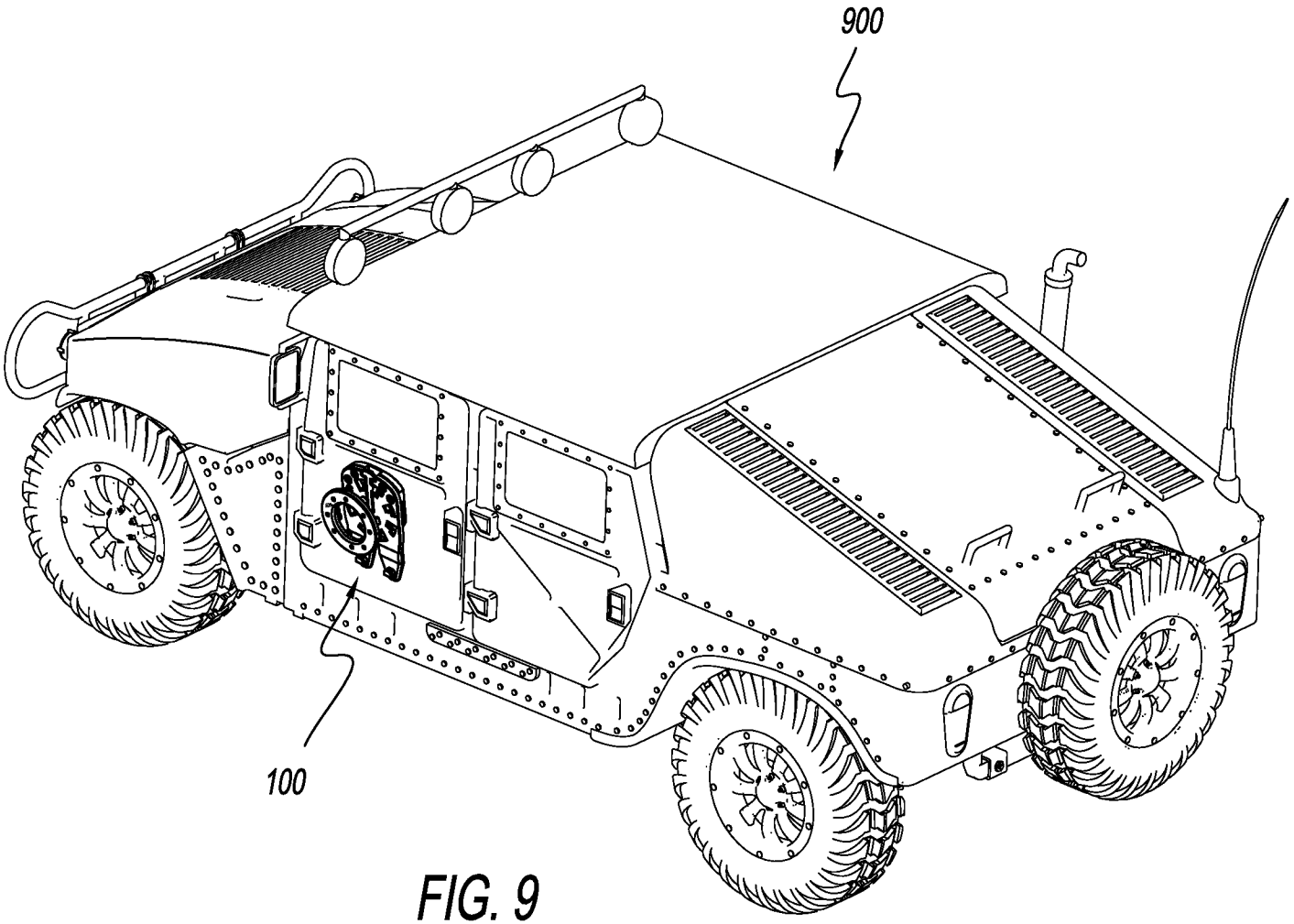
FIG. 9 depicts a lock mount secured to a vehicle, in accordance with embodiments described herein.

FIG. 9 depicts a lock mount secured to a vehicle 900, in accordance with embodiments described herein. The vehicle 900 includes an adjustable mount 100 secured thereto.

Figure 10:
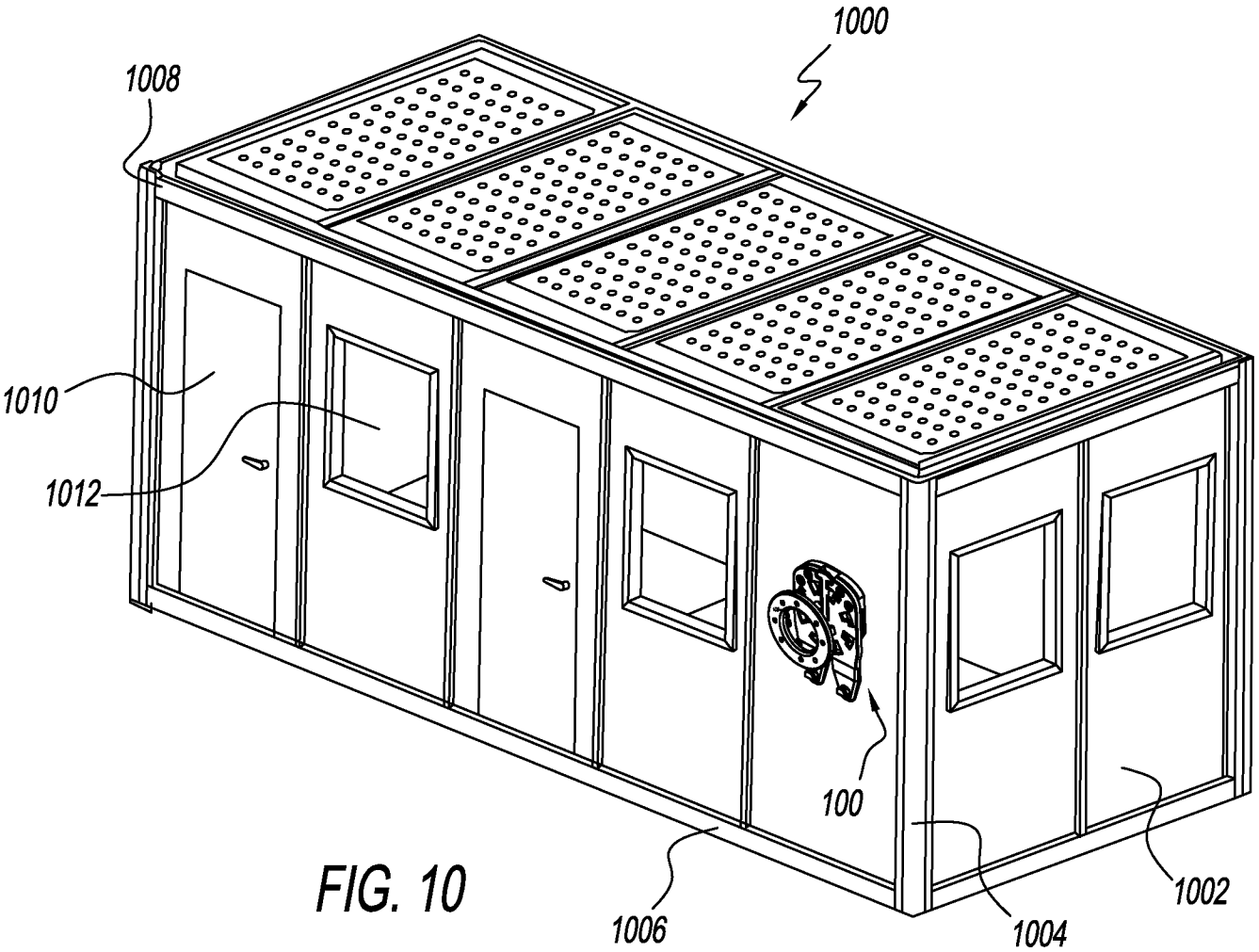
FIG. 10 depicts a lock mount secured to a building, in accordance with embodiments described herein.

FIG. 10 depicts a lock mount secured to a building 1000, in accordance with embodiments described herein. The building 1000 includes walls 1002 and corners 1004 where the walls 1002 meet. A roof 1008 is located above the walls 1002. The walls 1002 and roof 1008 rest on top of a base 1006. The building also includes a door 1010 and at windows 1012. Located on one of the walls is adjustable mount 100.

Figure 11:
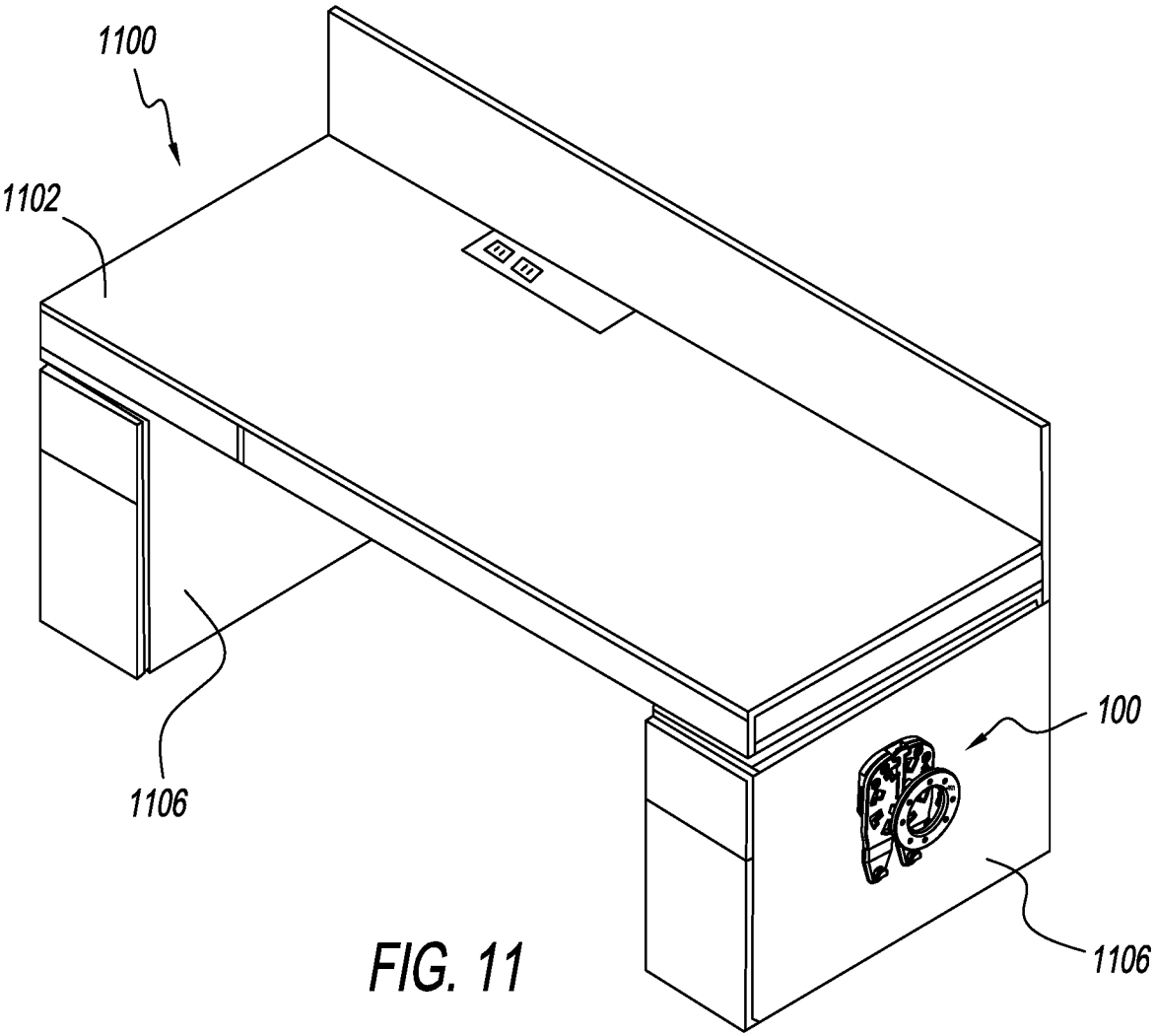
FIG. 11 depicts a lock mount secured to furniture, in accordance with embodiments described herein.

FIG. 11 depicts a lock mount secured to furniture, in accordance with embodiments described herein. For illustrative purposes, the furniture is depicted as a desk 1100. The desk 1100 includes a desk-top 1104 supported by desk-top supports 1106. Secured to the desk 1100 is an adjustable mount 100.

In the foregoing specification, specific embodiments have been described. However, one of ordinary skill in the art appreciates that various modifications and changes can be made without departing from the scope of the teachings disclosed herein as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The claimed material defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has," "having," "includes," "including," "contains," "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a," "has . . . a," "includes . . . a," or "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially," "essentially," "approximately," "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

The Abstract is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. An apparatus, comprising:

a first holster sleeve side wherein the first holster sleeve side includes an outer surface and an inner surface having a first tongue slot;

a second holster sleeve side secured to the first holster sleeve side wherein the second holster sleeve side includes an outer surface and an inner surface having a second tongue slot aligned with the first tongue slot;

a flexible tongue coupled to the first holster sleeve side and the second holster sleeve side by insertion into the first tongue slot and the second tongue slot wherein the flexible tongue includes an inside surface and an outside surface;

a male interlocking ring connected to the first holster sleeve side, the male interlocking ring having a first side including a plurality of male interlocking members each having a first extension extending from and perpendicular to the first side and a second extension extending perpendicularly from the first extension and parallel to the first side whereby each interlocking member has an L-shaped configuration;

a female interlocking plate having respective mounting holes including first portions and second portions wherein each first portion is larger than each second portion whereby each mounting hole also has an L-shape and each are configured for receiving each of the male interlocking members and removably interlock therewith; and a single flexible release lever mounted to the female interlocking plate and having a lever stop that extends generally perpendicularly to a longitudinal direction of the flexible release lever and being movable into and out of one of the portions that are adapted to receive one of the plurality of male interlocking members, the lever stop dimensioned and configured to prevent rotation of a male interlocking member and thereby disengagement of the male interlocking plate from the female interlocking plate after mating of the male interlocking ring and female interlocking plate until the single flexible release lever is moved by an operator which thereby solely provides for disengagement of the male interlocking ring and the female interlocking plate.

2. The apparatus of claim 1 wherein the female interlocking plate is configured for attaching to an object and wherein the object is a vest.

3. The apparatus of claim 1 wherein, the female interlocking plate further includes at least one strap hook extending from a first side of the female interlocking plate.

4. The apparatus of claim 1 further comprising an elastomeric strap secured to the first holster sleeve side and the second holster sleeve side.

5. The apparatus of claim 1 wherein the flexible tongue includes an ambidextrous release.

6. The apparatus of claim 5 wherein the ambidextrous release further comprises through holes on both sides of the ambidextrous release that are adapted to receive an ambidextrous thumb brake.

* * * * *